US006749551B2

(12) United States Patent
Metzler et al.

(10) Patent No.: US 6,749,551 B2
(45) Date of Patent: Jun. 15, 2004

(54) RESEALABLE CONTAINER WITH MAGNETIC CLOSURE SYSTEM

(75) Inventors: Steven Paul Metzler, Covington, VA (US); Mark Anthony Stanton, Louisa, VA (US)

(73) Assignee: Mead Westvaco Corporation, Stamford, CT (US)

( * ) Notice: Subject to any disclaimer, the term of this patent is extended or adjusted under 35 U.S.C. 154(b) by 57 days.

(21) Appl. No.: 10/045,371

(22) Filed: Jan. 15, 2002

(65) Prior Publication Data

US 2003/0132276 A1 Jul. 17, 2003

(51) Int. Cl.[7] ..... B31B 1/28
(52) U.S. Cl. ..... 493/156; 493/183; 493/469
(58) Field of Search ..... 493/183, 156, 493/469, 397, 405, 453

(56) References Cited

U.S. PATENT DOCUMENTS

| | | | | |
|---|---|---|---|---|
| 3,749,301 A | | 7/1973 | Peckar | |
| 4,232,592 A | * | 11/1980 | Gingerich | 493/10 |
| 4,333,602 A | * | 6/1982 | Geschwender | 229/125.39 |
| 4,632,299 A | | 12/1986 | Holmberg | |
| 4,738,390 A | | 4/1988 | Brennan | |
| 4,848,575 A | * | 7/1989 | Nakamura et al. | 206/449 |
| 5,505,305 A | | 4/1996 | Scholz et al. | |
| 5,609,788 A | | 3/1997 | Deetz | |
| 5,843,329 A | | 12/1998 | Deetz | |
| 6,059,182 A | * | 5/2000 | Wein | 229/219 |
| 6,217,405 B1 | * | 4/2001 | Burrows | 446/135 |
| 6,295,920 B1 | * | 10/2001 | Barden et al. | 99/297 |
| 6,352,497 B1 | * | 3/2002 | Hensley et al. | 493/22 |

* cited by examiner

*Primary Examiner*—Eugene Lee Kim
(74) *Attorney, Agent, or Firm*—Donald L. Bowman

(57) ABSTRACT

A container body with a container opening and a flap partially secured to the container body and completely covering the container opening is disclosed. The flap is secured to the container by a hinge or fold line and formed from the same substrate as the container body. The container body contains a first magnetic region adjacent to and surrounding the perimeter of the container opening. The flap contains a second magnetic region aligned with and opposite the container body's first magnetic region. The first and second magnetic regions are magnetically attracted to each other. The flap is held in a closed position by magnetic attraction between the flap's magnetic region and the container body's magnetic region.

6 Claims, 6 Drawing Sheets

105
122
126
120
152
108
134
104
106
132
104
106
108
140
158

100
160
150
120
122
158
140
153
152
154
108
130
104
132
134
136
106
170
172
174
176

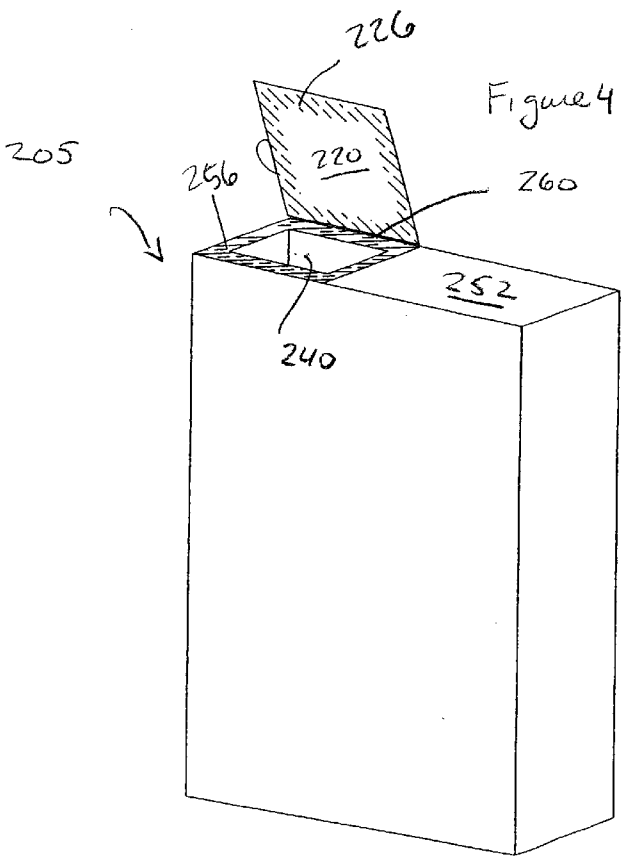
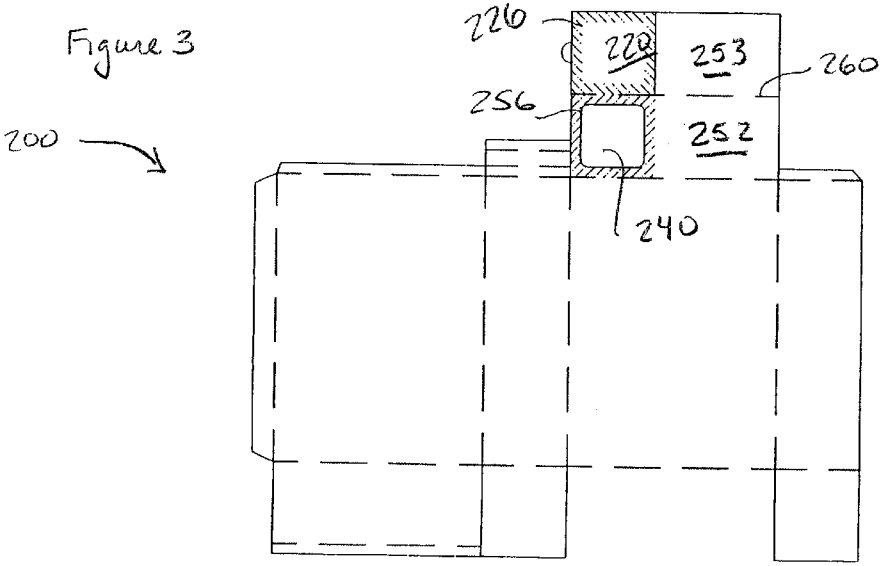
Figure 3

500

RESEALABLE CONTAINER WITH MAGNETIC CLOSURE SYSTEM

BACKROUND OF THE INVENTION

This invention relates to a structure and method of fabricating a resealable container with a magnetic closure system.

Containers store, retain and preserve numerous products. Containers are made from a variety of materials and are formed into many shapes and sizes. An exemplary conventional container is a cereal box made from paperboard. Generally, after placing a product in a container the container is closed. Containers designed for "one time" use generally do not have a re-closure system. However containers that dispense a product at intermittent intervals, such as cereal boxes, generally require a re-closure system. Conventional re-closure systems include an arrangement of opposing flaps on the container, for example at the top of a container. In a "tab and slot" system a tab extending from a first flap of the container is tucked into a slot located on an opposing flap. The tab and slot secure the opposing flaps in a closed position.

The aforementioned conventional container "tab and slot" re-closure system works well mechanically so long as the initial opening of the container does not tear or deform the container flaps or tab. The ease of initially opening the container depends upon the strength of the bonds that holds the opposing container flaps together. Conventionally, opposing flaps are secured to each other by various adhesive compounds. The type and amount of adhesive used is chosen to balance the strength of the container's initial seal with the ease of initially separating the opposing flaps from each other. A major deficiency with the conventional "tab and slot" re-closure system is that after opening, the re-closure system does not provide an acceptable container barrier, especially for food or perishables items.

To address this shortcoming, perishable items are conventionally placed in a in an air, moisture, and vermin barrier, hereinafter referred to as "membrane." The membrane is vacuum sealed before the container is closed. For example, food products, such as cereal, crackers, biscuits, and cookies are conventionally sealed in a separate membrane before the container is initially sealed. The membrane serves to protect the product prior to the initial opening of the container and provides additional barrier protection after the container is open. Membrane materials typically comprise plastic, foil, or paper that has been laminated or coated to produce the desired barrier properties, such as air, moisture, and vermin control.

The integrity of the membrane and the available time interval for safely consuming the membrane's product depends directly upon the care with which the membrane was initially opened as well as the care with which the membrane is re-closed after each opening. A typical membrane is re-closed by rolling the membrane from the top until the roll is tight against the product. Additional methods include clipping or otherwise securing the rolled up membrane to eliminate unrolling. A main disadvantage of the "rolling" method is that it requires attention and care by the user. In addition, the rolling method often fails to produces an adequate seal for perishable products even when the user rolls according to best practice. In sum, conventional membrane re-closure techniques do not adequately protect perishable products. As a result the available consumption time for a product is not maximized.

A variety of other container re-closure systems exist. They can be classified into four general categories: (1) zippers, (2) pinching aids such as metallic ties and plastic clips, (3) spouts of various sorts including folding, pullout, and screw-top types, and (4) various closure flap retention systems. Zippers generally include a design where a container has an integrated zipper re-closure system formed in either the container or membrane. Pinching aids are conventional devices typically applied to the container flaps and/or membrane. An exemplary use of a pinching aid is to secure the rolled up portion of a membrane. Container spout designs include the use of paperboard or plastic elements secured to both containers and/or membranes that aid in removing the product from the container and can be repositioned to cover a container opening.

Flap retention systems secure moveable flaps to cover openings in the container. Conventionally flaps require the use of pressure sensitive adhesive or magnetic forces to secure the flap over the opening. An exemplary flap adhesive re-closure system is disclosed in U.S. Pat. No. 4,632,299 by Albert Holmberg, entitled "Reclosable Containers." It discloses a container with an opening and a closure flap to cover the opening. The flap's perimeter has a pressure sensitive adhesive tape that secures the flap to the container. However, a major disadvantage of the Holmberg container is the possibility that debris will accumulate upon the adhesive coating causing incomplete sealing of the flap to the container. In addition, after repeated openings, the adhesive coating may weaken or fail, leaving the flap unsecured or partially unsecured to the container. In addition, the adhesive flap re-closure system requires care and attention by the user to properly secure the flap against the container.

An exemplary magnetic re-closure system is disclosed in U.S. Pat. No. 4,738,390 by Gerald Brennan, entitled "Magnetic Closure Device For Envelope or the Like." A second exemplary magnetic re-closure system is disclosed in U.S. Pat. No. 3,749,301 by George Pecker, entitled "Magnetically Sealable Container." Finally a third exemplary magnetic closure system is disclosed in U.S. Pat. No. 5,505,305 by Matthew Scholz, et. al., entitled "Moisture-Proof Resealable Pouch and Container." The three examples each rely on magnetic attractive forces to secure a "flap-like" article to the container. However these conventional magnetic re-closure systems either fail to provide a secure container barrier for perishable items or require the use of a membrane in addition to the magnetic closure system to obtain acceptable product protection.

In summary, conventional container re-closure systems do not achieve an easy, low cost, and reliable re-closure system. As a result containers with conventional re-closure systems fail to provide an optimum air, moisture, and vermin barrier. In addition, adding a conventional membrane internal to the container to improve product protection results in increased packaging costs and fails to optimize product protection.

What is needed is a container with a re-closure system that provides an improved container seal after initial opening that is easy to open and close, is low cost, reliable, and requires little attention from the user. In addition, what is needed is a container with a re-closure system that eliminates the need and cost of an internal membrane.

SUMMARY OF INVENTION

The invention fulfills these needs not met by the prior art by providing a re-closure system for a container that is easy to open and close, reliable, and provides an air, moisture, and vermin barrier superior to that offered by a conventional membrane and container system.

In general, the invention includes a container body with at least one opening. A flap is partially secured to the container body and completely covers the container opening. The flap is secured to the container by a hinge or fold line and formed from the same substrate as the container body. The container body contains a first magnetic region adjacent to and surrounding the opening. The flap contains a second magnetic region aligned with and opposite the container body's first magnetic region. The first and second magnetic regions are magnetically attracted to each other.

The contents of the container are removed by moving the flap to an open position. The container product is not placed in a membrane. The container is re-closed by returning the flap to a closed position. The flap is held in a closed position by magnetic attraction between the flap's magnetic region and the container body's magnetic region. The magnetic force is provided by forming active magnetic zones on both the container body and flap, or alternatively, one magnetic zone and a magnetically receptive zone arranged on the opposing part. The magnetic zones are dimensioned to extend around the entire border or perimeter of the opening and at optimized width to provide a good barrier seal.

In a first exemplary embodiment, magnetic gaskets cut from commercially available flexible magnetic sheet are secured to the container body and flap in the desired pattern and location. The magnetic gaskets are then polarized to create magnetically attractive regions.

In a second exemplary embodiment, magnetic regions are formed on the flap and container by printing ink containing ferrite material in the desired pattern and location. The ferrite regions are then polarized to create magnetically attractive regions.

BRIEF DESCRIPTION OF THE DRAWING

The above and other features of the present invention which will become more apparent in the description below, and can be understood by the following detailed description in conjunction with the accompanying figures, wherein like characters represent like parts throughout the several view and in which:

FIG. 3 is a plan view of a second embodiment of a blank container with a top flap according to the invention;

FIG. 4 is an orthogonal view of a container formed from the blank of FIG. 2;

DETAILED DESCRIPTION OF THE INVENTION

Figure 1:
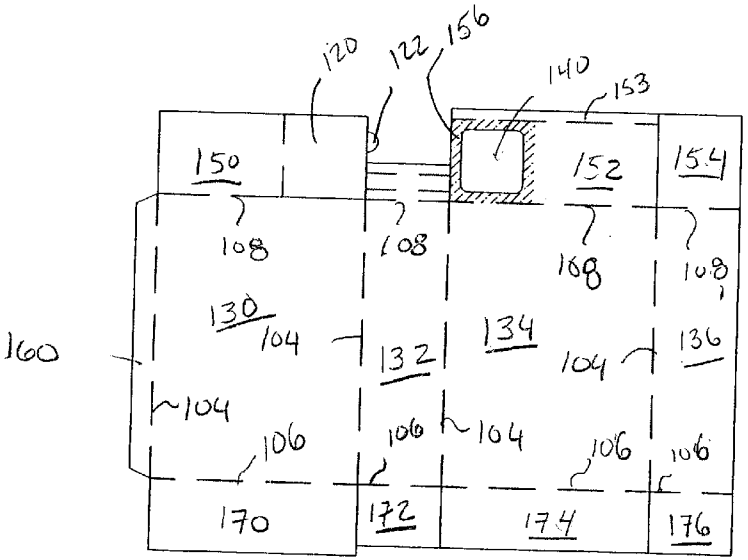
FIG. 1 is a plan view of a blank for a container with a top flap according to the invention.

FIG. 1 illustrates an exemplary container blank or substrate 100 for forming a container 105 (FIG. 2) according to the invention. In an exemplary embodiment the blank 100 is made from paperboard or paper. However it is to be understood that the invention covers a wide range of suitable materials for blank 100 including various plastic compositions and laminates.

Figure 2:
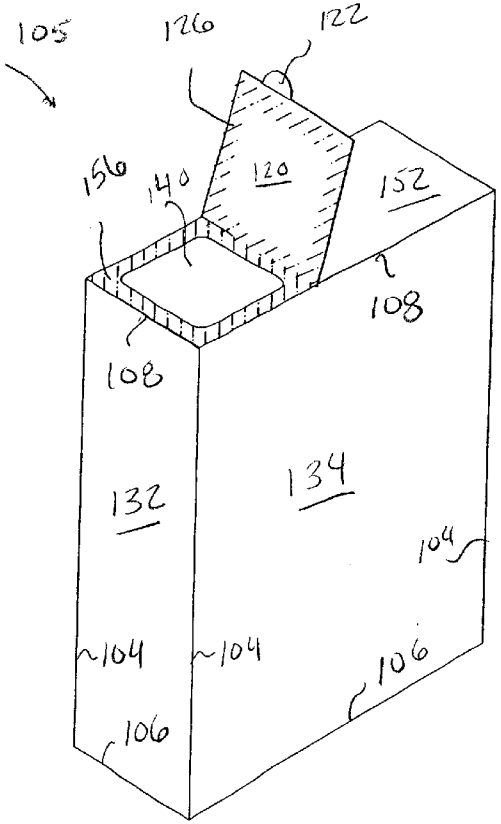
FIG. 2 is an orthogonal view of a container formed from the blank of FIG. 1.

In an exemplary embodiment, blank comprises four bottom sections, 170, 172, 174, 176, four main body sections 130, 132, 134, 136, and four top sections 150, 152, 153, 154. The blank 100 has a plurality of fold lines 104, 106, 108. The blank 100 sections are folded and cut to form container 105 (FIG. 2). Glue flap 160 is one means to secure the folded main body sections 130, 132, 134 in the shape of a conventional container shape. Bottom sections 170, 172, 174, 176 and top sections 150, 152, 153, 154 are cut and folded to form a closeable top and bottom for the container 105. Top section 153 provides a glue flap to provide integrity to the container.

An aperture 140 is formed in the top section 152 of the blank 100 using conventional techniques. A first ferrite or magnetic region 156 is formed on the perimeter and adjacent to aperture 140. The method of forming the ferrite or magnetic regions will be discussed below. An exemplary flap 120 is formed in a top section 150 of blank 100. The flap is formed by making cuts along section 150 using conventional methods. A second ferrite or magnetic region 126 is formed on a side of flap 120 opposite the first ferrite region 156. Flap 120 is shown with optional tab 122 to assist with opening and closing the container 105 via the flap 120. The tap 122 can be formed from cutting a portion of the blank 100 using conventional methods. The container 105 of FIG. 2 can be formed using the blank of FIG. 1 using conventional techniques well known in the art.

If container 105 stores perishable items such as breakfast cereal, then the re-closure system (flap and opening with first and second magnetic region) must be arranged or dimensioned to provide adequate barrier properties, such as moisture, air, and vermin barriers for the container 105. By properly designing the ferrite or magnetic regions, the conventional membrane for the perishable products can be eliminated. In an exemplary embodiment, the blank 100 for the container 105 is coated with polymeric material to create the desired barrier properties. Exemplary coatings include extrusion coating of various polyethylenes onto the side of the blank 100 which will form the interior of the container 105. To protect against tampering with the container 105, the flap 120 can have a tamper seal or tear off strip (not shown), surrounding the flap 120 which is broken or removed when the container 105 is initially opened. Exemplary tamper seals are made from paper or cellophane, although a wide-range of tamper proof measures are encompassed by the scope of the invention.

The formation of the ferrite or magnetic regions, hereinafter referred to as ferrite regions, may be accomplished by several exemplary methods. In a first exemplary embodiment, the ferrite regions are formed from magnetic gaskets to form a re-closure system as discussed above. The magnetic gaskets are made from commercially available flexible magnetic sheeting, such as magnetic sheets made by Plastiform Division of Arnold Engineering. Magnetic sheets of this type are conventionally used for magnetic tags, signs, "refrigerator magnets," and the like. The magnetic sheets are pre-cut prior to placement on the blank 100 to the desired shape and size. The magnetic gaskets are then bonded to the flap or container blank using a conventional labeling machine adapted for this purpose.

Various types of labeling equipment are used in the packaging industry to apply labels to almost any type container, with a high degree of placement accuracy and at production rates of many thousands of containers/hour. The magnetic gaskets may have pre-applied pressure sensitive adhesive ("PSA") or a gluer can be used to apply adhesive, in the desired pattern, to each container blank. Application of the magnetic gaskets may be applied "inline" on the same continuous production line that prints, cuts, and scores the base substrate web in form to produce individual carton blanks.

According to this embodiment the magnetization pattern (spatial extent of the zonal bands of magnetization and their polarity) are exactly the same for the flap magnetic strip and the container opening magnetic strip. For example, if spatial arrangement of the opposing magnetic gaskets is exactly the same but with opposite magnetic polarity, the magnetic force produced between the flap and the container will be repulsive rather than attractive. Thus, maximum attractive force between the flap and container will be produced only if the magnetization zonal patterns of the two regions are "in register" and aligned.

In order to achieve accurate magnetic register with stacked blanks, and also to avoid possible production problems, such as feeding problems, i.e., two or more container blanks sticking together, prior to the cartons erection and filling, magnetization of the magnetic gaskets may be done on the container filling line itself Accurate magnetic pole registration is possible on a carton filling line by using a jig that keys in, or counter-fits to the external contour of the carton blank to precisely locate and align the blank relative to the magnetizing fixture. The magnetizing fixture poles (assuming a linear magnetization pattern) are either exactly parallel or perpendicular to the folding axis of the closure flap. For cartons made from a single blank whose closure flap is directly attached to the body of the carton by a score-fold, the latter orientation will in practice yield the most consistent result, as the effect of small flexional displacements at the folding score is thus obviated.

The holding strength of flat, sheet-form magnets is a function of the number of poles-per-inch of the magnetization pattern, where a fine pattern (having a large number of poles/inch) increases the holding strength of a magnet, all else (magnet composition and thickness) equal. Choice of a poles/inch value for a magnetic closure will thus be a tradeoff between a desirable high holding strength and the degree to which it is possible to maintain magnetic register. A value of ~10–12 poles/inch should strike a satisfactory balance, and this value is in fact within a range conventionally used. State of the art magnetizers currently can have up to 18 poles/inch, and 50 poles/inch is said to be attainable. This latter value suggests an alternative approach to achieving magnetic polar register.

Two sheet-type magnets that are magnetized at 50 poles/inch will re-establish register each time they are displaced relative to each other by 1/25th of an inch in a shearwise fashion (and in a direction perpendicular to their lines of polarization). If the hinge point between the closure flap and carton is made flexible and compliant, the flap will automatically position itself so that its magnetization pattern is in register with that of the carton. One embodiment of this approach for a paperboard container would be to have a separate closure flap joined to the container via a strip of polymeric material in thin sheet form, such as any type plastic film conventionally used to make so-called flexible packaging, i.e.; polyethylene. Now, the most advantageous orientation of a (linear) magnetization pattern on the flap and container would be to have the lines parallel to the folding axis. Then, width of the film that bridges the gap between the flap and container to form a hinge would only need to be on the order of a small multiple of the 1/25 inch "repeat length" just described—say 0.1 to 0.125 inches. For illustration purposes, the techniques described above yield for a flap design of FIGS. 1 and 2 a tensile opening force (applied to the tab on the end of the flap) equal to approximately 0.25 lbf. This is enough resistance to prevent accidental opening due to the weight of the contents, should the box fall over or be laid down on its side.

An approach that by-passes the necessity of providing accurate polar registration between magnetic gaskets upon the carton body and flap is to magnetize only one of the gaskets. The opposing non-magnetized gasket is made from a magnetically receptive material such as "Rubber Steel"® made by Magnum Magnetics, Inc. A magnetically receptive paint (Magic Wall™ latex) is made by Kling Magnetics, Inc. under license of U.S. Pat. Nos. 5,609,688 and 5,843,329. From a functional standpoint it does not matter which surface is magnetically receptive, i.e, the flap or the container. However, various product promotional purposes, such as advertisement, collectibles, product data, etc, could be served if the flap's gasket is magnetized and easily removable. As previously mentioned, magnetization of a single magnetic gasket would likely be done later on the filling line, to avoid possible feeding problems with stacked blanks.

An alternative to using a polymer-based, flexible magnetic sheet to form a carton closure is to print magnetic regions directly onto the container blank. In an exemplary print method, the ferrite particles are mixed with a binder, which can be a latex-, oil-, or lacquer-based paint, ink, or coating, for subsequent printing or coating application to the paperboard.

Magnetization is then done by conventional means (application of an external magnetic field of strength sufficient to align the "domains" of the magnetic filler particles). Strength of the magnet thus produced is a function of the thickness of the coated or extruded magnetic layer, magnetic particle packing density within the binder, and the particular magnetic compound chosen for use.

An exemplary magnetic region forming technique is a screen printing press method. Screen printing has an advantage since the amount of ink that can be applied in terms of ink deposition thickness is much greater than other printing processes (e.g. rotogravure, flexographic, offset lithography). Magnetic holding strength is known to be a strong function of the volumetric packing density of ferrite that composes a magnetic layer. Of the three types (ultraviolet cured, heat cured, and solvent based) ink used in the experiments, solvent based inks gave the highest volume fractions of ferrite, and consequent best magnetic performance. This is first of all because the solvent based ink had a lower initial viscosity than the other types ink, so that more ferrite could be mixed with the ink before viscosity of the mixture increased to a point beyond which printing is possible. Secondly, and very important, much of the initial volume of the ink is lost through solvent evaporation: the drying and curing process effectively acts to concentrate the volume fraction of ferrite in the printed layer. An additional process step is necessary, however, to obtain maximum ferrite packing density. Solvent evaporation leaves air voids in the ferrite/ink mixture, so it is necessary to compact the printed layer when it is yet in a semi-cured, plastic state. This can be done by passing the printed substarte through one or more lightly loaded (less than 20 kN/meter ~114 lbf/lineal inch) "nips" formed between hrad rolls covered with a suitable release-type coating (Teflon®, for example). By this means, thickness of a solvent-based, printed ferrite layer can be decreased (and its density increased) by a factor of two, and volumetric fractions of ferrite in excess of 75% can be attained.

Magnetic properties of the printed layer may be further enhanced by creating a strong magnetic field within the nip itself, so as to induce a degree of anisotropy within the magnetic layer (a purely anisotropic magnet is one whose individual magnetic domains share a common, parallel orientation). A magnetic field having the desired orientation (perpendicular to the web) may be created within the nip zone by constructing the rolls from a ferromagnetic material (iron or steel, for example), and installing electromagnetic coils on the side of each roll opposite the nip. This approach is potentially most advantageous for so-called "high energy" ferrites, whose individual particles are intentionally made to be a single magnetic domain—within the industry, this is termed "uniaxial crystalline anisotropy." The unipolar magnetic field of each individual particle tends to orient itself parallel to the field imposed within the roll nip. An additive effect of the roll nip is its ability to mechanically orient those types ferrite powder whose particulate morphology is intentionally manipulated during manufacture to create plate-shaped particles having a length and width greater than the thickness—fluid shear within the nip zone acts to mechanically orient the platelike particles parallel to the plane of the web. Magnetic orientation of these ferrites is typically made to be normal to the plane of the particle, so the net (and intended) effect of particle orientation induced by both magnetic and mechanical means is to create a non-isotropic magnet. These techniques form part of the conventional art of manufacturing flexible polymer-based magnets, but are here extended to the potential production of magnets created by the printing ferrite ink.

An exemplary ferrite region was formed using an ink (Coates Screen Gloss Vinyl C-99 mixing clear) chosen for its high degree of mechanical flexibility when cured. Weight proportions of six parts ferrite, one part mixing clear, and 2.4 parts reducer were combined to make the ferrite ink. The mixing clear contains approximately 70% volatile solvent and 30% binder by weight: the above proportions provide a mixture that can be printed and cured to contain at least 75% ferrite by volume. Use of a 60 mesh screen, a 200 micron emulsion, and a 60 durometer squeegee yielded a per pass dried film thickness of approximately 7 mils after being consolidated in a roll nip. Ferrite layers 0.014 inches thick were produced by overprinting (double thickness) and then were magnetized at 18 poles/inch. Magnetic holding strength was 1.3 ounces/square inch, about 30% that of a typical, 0.020 inch thick flexible bonded magnet.

One problem with producing magnetic zones by direct printing of ferrite ink onto a substrate is the extremely heavy ink application rate required. A typical ink thickness, or laydown, of screen printed graphic designs for packaging applications is ~0.0005 inches, or 1/30 the amount cited above. This means that drying and curing of a screen printed magnetic surface is presently a production bottleneck. Even with compact designs for forced air dryers (vertical units with serpentine web runs) are available, drying rate limitations inherent to thick coatings would dictate layers as thick as 0.015 inches would have to be printed using multiple print stations. Thus direct printing approaches require expensive dryers and have slow production rates.

FIGS. 3 and 4 illustrate another top flap container arrangement. Blank 200 has two top sections 252, 253 connected by fold line 260. An aperture 240 is formed in top section 252. A first magnetic region 256 is formed on top section 252 and a second magnetic 226 is formed on top section 253. Blank 200 is folded as described above in FIGS. 1 and 2 to form container 205 (FIG. 4).

Figure 6:
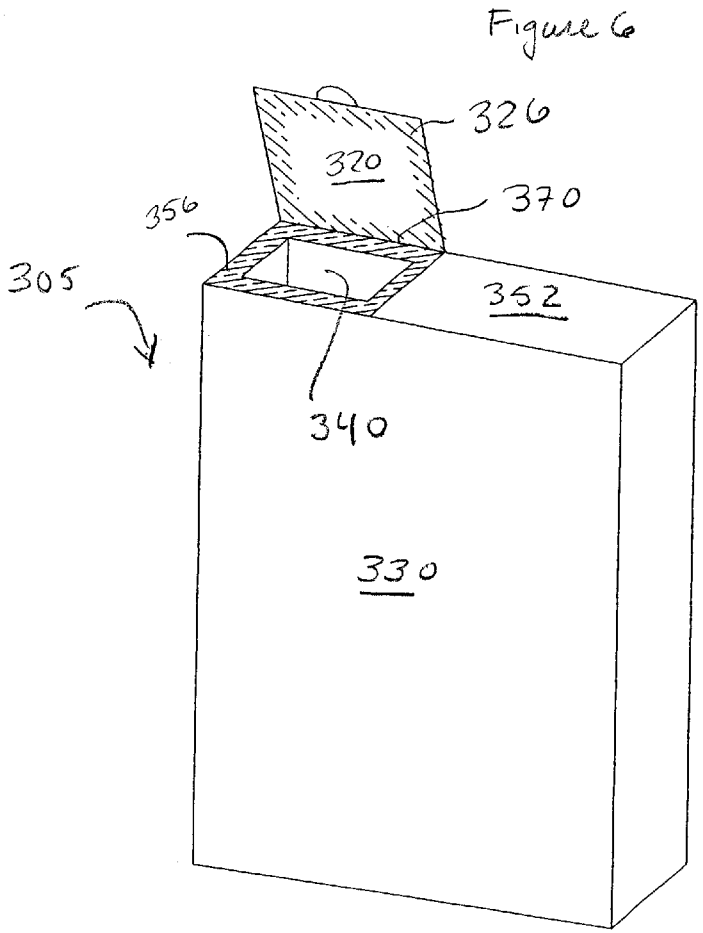
FIG. 6 is an orthogonal view of a container formed from the blank of FIG. 5.
Figure 5:
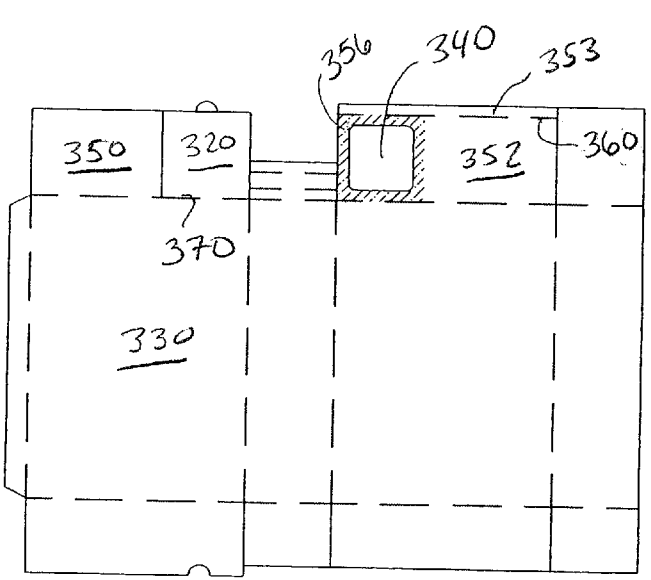
FIG. 5 is a plan view of a third embodiment of a blank container with a top flap according to the invention.

FIGS. 5 and 6 illustrate another top flap container arrangement. Blank 300 has four top sections 350, 320, 352, 353. An aperture 340 is formed in top section 352. A first magnetic region 356 is formed on top section 352 and a second magnetic 326 is formed on flap 320. Blank 300 is folded as described above in FIGS. 1 and 2 to form container 305 (FIG. 6). Flap 320 is connected to body section 330 along hinge line 370.

Figure 8:
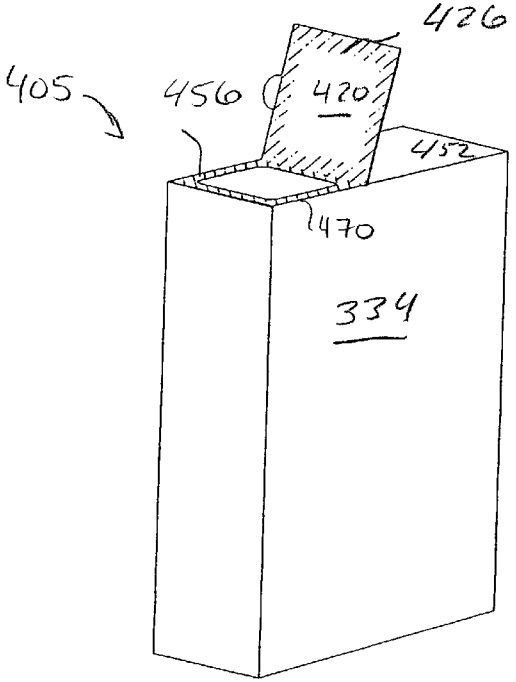
FIG. 8 is an orthogonal view of a container formed from the blank of FIG. 7.
Figure 7:
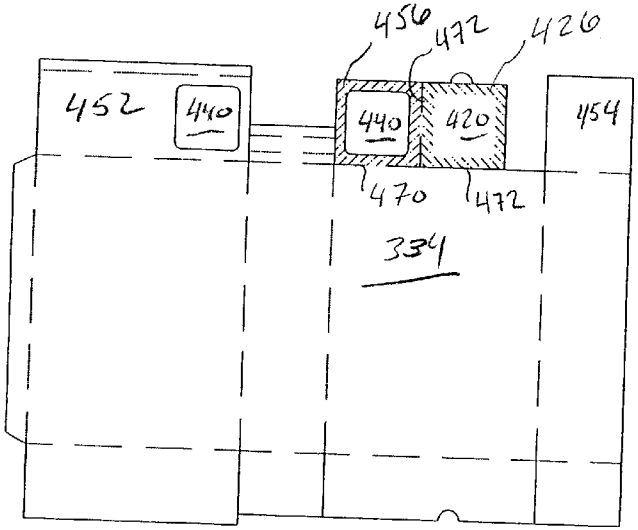
FIG. 7 is a plan view of a third embodiment of a blank container with a top flap according to the invention.

FIGS. 7 and 8 illustrate another top flap container arrangement. Blank 400 has three top sections 452, 420, 454. An aperture 440 is formed in top sections 452, 420. A first magnetic region 456 is formed on top section 420 and a second magnetic 426 is formed on top section 420. Blank 400 is folded as described above in FIGS. 1 and 2 to form container 405 (FIG. 8). Top section 420 is connected to body section 340 along hinge line 470. Top section 420 is cut along line 472 to form a flap that covers aperture 440.

Figure 10:
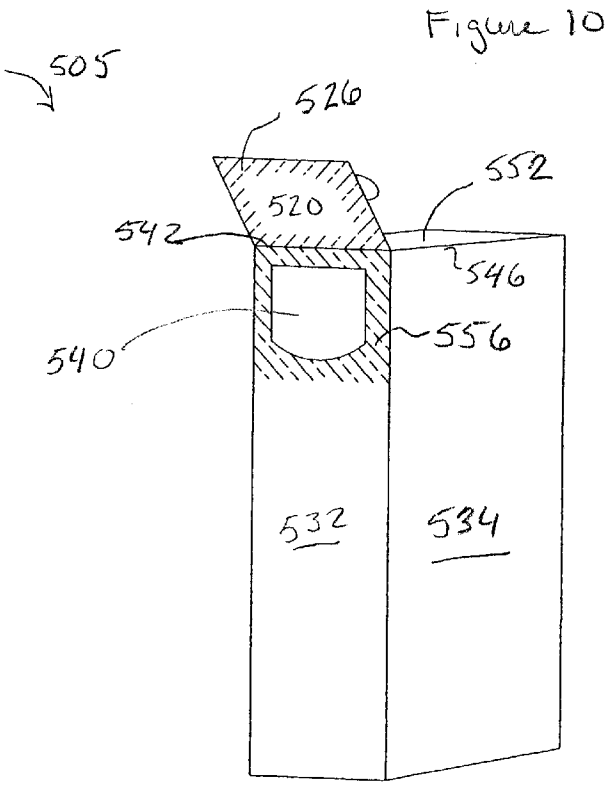
FIG. 10 is an orthogonal view of a container formed from the blank of FIG. 9.
Figure 9:
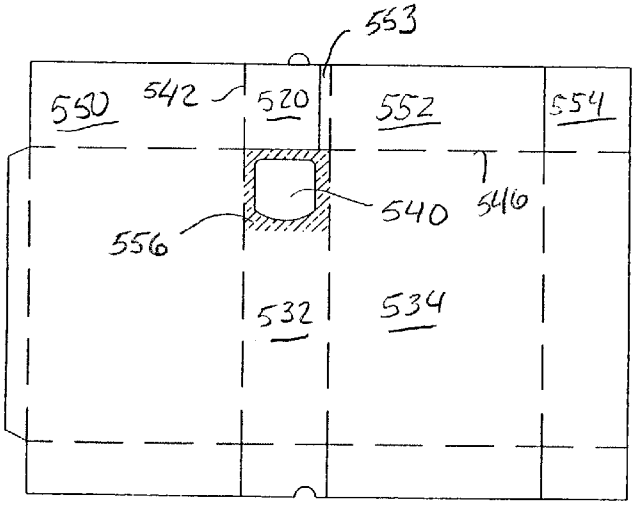
FIG. 9 is a plan view of a blank container with a side flap according to the invention.

FIGS. 9 and 10 illustrate a slide flap container arrangement. Blank 500 has four top sections 550, 520, 552, 554. An aperture 540 is formed in main body sections 532. A first magnetic region 556 is formed on main body section 532 and a second magnetic region 526 is formed on top section 520. The second magnetic region 526 is formed on an opposite side of blank 500 from the first magnetic region 556. Blank 500 is folded as described above in FIGS. 1 and 2 to form container 505 (FIG. 10). Top section 552 is connected to body section 534 along hinge line 546. Top section 520 is cut along line 553 to form a flap 520 that covers aperture 540. Flap 520 is connected to top section 550 along hinge line 542.

Figure 12:
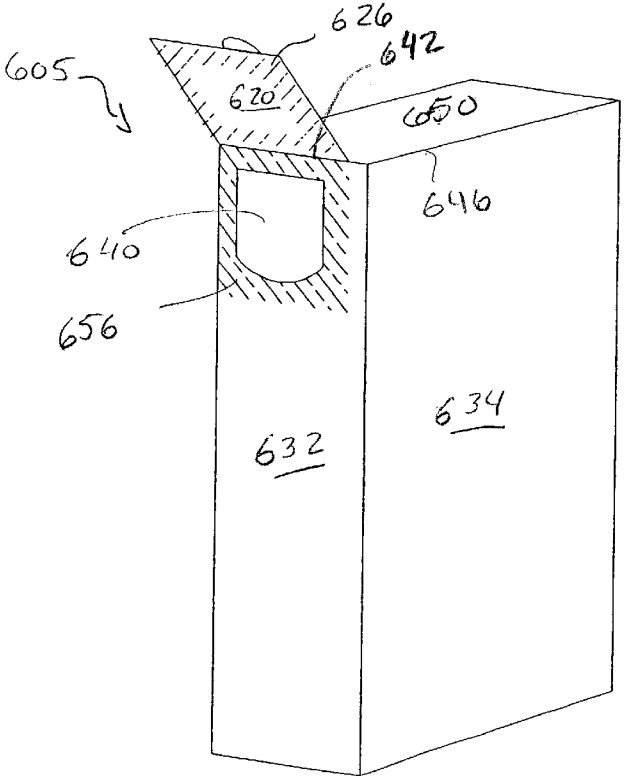
FIG. 12 is an orthogonal view of a container formed from the blank of FIG. 11.
Figure 11:
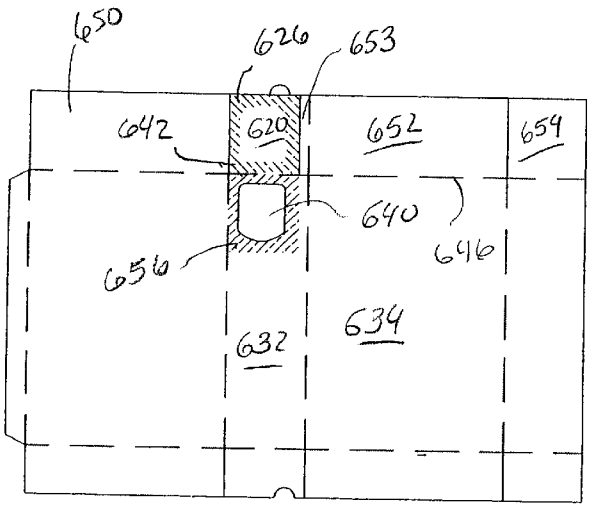
FIG. 11 is a plan view of a second embodiment of a blank container with a side flap according to the invention.

FIGS. 11 and 12 illustrate a second embodiment of a slide flap container arrangement. Blank 600 has four top sections 650, 620, 652, 654. An aperture 640 is formed in main body sections 632. A first magnetic region 656 is formed on main body section 632 and a second magnetic region 626 is formed on top section 620. The second magnetic region 626 is formed on the same side of blank 600 as the first magnetic region 656. Blank 600 is folded as described above in FIGS. 1 and 2 to form container 605 (FIG. 12). Top section 652 is connected to body section 634 along hinge line 646. Top section 620 is cut along line 653 to form a flap 620 that covers aperture 640. Flap 620 is connected to top section 650 along hinge line 642.

It is to further be understood that the opening, flap, and magnetic regions of container formed according to the invention can have numerous arrangements, configurations, designs, locations, and dimensions within the scope of the invention. In addition the body of the container and flap can be formed from a single or a plurality of blanks using techniques well know in the art to form containers. It is to further be understood that the term ferrite or magnetic region encompasses a wide range of material capable of either forming a sufficiently strong magnetic field or being sufficiently magnetically receptive to allow a sufficiently strong enough magnetic attraction to form between the flap and the container body. Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method of forming a container blank comprising the steps of:

providing a substrate;

cutting said substrate to form at least two side panels, two end panels; at least one glue panel extending from at least one end panel, at least two top panels, at least one bottom panel, and a plurality of dust panels secured to said plurality of top and bottom panels;

forming an aperture on a first top panel;

forming a moveable flap on a second top panel wherein said moveable flap is aligned with and larger than said aperture;

securing a first ferrite material around the external perimeter of said aperture on the external side of said container;

securing a second ferrite material around the interior perimeter of said moveable flap and on the opposite side of the substrate from said first ferrite material;

generating a first magnetic field in said first ferrite material;

generating a second and opposite magnetic field in said second ferrite material;

forming fold lines between said plurality of panels;

folding said plurality of panels to form a container wherein said moveable flap is aligned with and covers said aperture in a closed position and wherein said second ferrite material is secured to said first ferrite material by magnetic attraction.

2. The method of claim 1, wherein said first and second ferrite materials are fanned from non-polarized gaskets.

3. The method of claim 1, wherein said first and second ferrite materials are formed from ink containing metallic particles.

4. The method of claim 3, wherein said ferrite regions materials are formed by printing said ink and passing the printed substrate through one or more nips formed between hard rolls covered with a release coating, wherein said ink is in a elastic state when passing through the nips.

5. The method of claim 4, wherein said hard rolls are constructed from a ferromagnetic material and are provided with electromagnetic coils to generate a strong magnetic field oriented normal to the plane of said substrate so as to induce a degree of magnetic anisotropy within said ferrite materials, thus enhancing their magnetic properties.

6. A method of forming a container comprising the steps of:

providing a substrate;

cutting said substrate to form at least two side panels, two end panels; at least one glue panel extending from at least one end panel, at least two top panels, at least one bottom panel, a least one moveable flap, and a plurality of dust panels secured to said plurality of top and bottom panels;

forming an aperture on a first end panel;

forming a moveable flap from said substrate wherein said moveable flap is aligned with and larger than said aperture;

securing a first ferrite material around the external perimeter of said aperture on the external side of said container;

securing a second ferrite material around the interior perimeter of said moveable flap and on the opposite side of the substrate from said first ferrite material;

generating a first magnetic field in said first ferrite material;

generating a second and opposite magnetic field in said second ferrite material;

forming fold lines between said plurality of panels;

folding said plurality of panels to form a container wherein said moveable flap is aligned with and covers said aperture in a closed position and wherein said second ferrite material is secured to said first ferrite material by magnetic attraction.

* * * * *